United States Patent [19]

Nakayama et al.

[11] Patent Number: 5,020,972

[45] Date of Patent: Jun. 4, 1991

[54] METHOD AND APPARATUS FOR PREVENTING THE NO-LOAD OPERATION OF A PUMP FOR A LIQUID SUPPLY SYSTEM

[75] Inventors: Shunichi Nakayama, Takasaki; Masashi Kanai, Azuma; Yasuyuki Arai, Sakai, all of Japan

[73] Assignee: Sanden Corporation, Gunma, Japan

[21] Appl. No.: 442,800

[22] Filed: Nov. 29, 1989

[30] Foreign Application Priority Data

Nov. 29, 1988 [JP] Japan ..... 63-99436

[51] Int. Cl.[5] ..... F04B 49/02

[52] U.S. Cl. ..... 417/37; 417/12; 417/44; 417/53; 417/63; 141/83

[58] Field of Search ..... 417/12, 37, 63, 44, 417/53; 222/56, 65, 63, 77, 463; 141/83, 95

[56] References Cited

U.S. PATENT DOCUMENTS

| | | | |
|---|---|---|---|
| 4,456,432 | 6/1984 | Mannino | 417/63 |
| 4,507,054 | 3/1985 | Schoenmeyr | 417/12 |
| 4,753,277 | 6/1988 | Holcomb et al. | 141/83 |
| 4,856,563 | 8/1989 | Yamaguchi et al. | 141/83 |

*Primary Examiner*—Leonard E. Smith
*Assistant Examiner*—David W. Scheuermann
*Attorney, Agent, or Firm*—Banner, Birch, McKie & Beckett

[57] ABSTRACT

An apparatus and method for preventing the no-load operation of a pump for a liquid supply system which responds to a sensor signal indicating that insufficient liquid in the supply exists for properly supplying liquid from a supply tank to a reservoir tank is described. The device provides a user indication that the supply tank liquid needs replenishment. Further, the device also detects when the pump supplying liquid from the supply tank to the reservoir tank operates for a period of time longer than a predetermined period of time. The device also provides a user with an indication that such a condition exists.

18 Claims, 5 Drawing Sheets

METHOD AND APPARATUS FOR PREVENTING THE NO-LOAD OPERATION OF A PUMP FOR A LIQUID SUPPLY SYSTEM

TECHNICAL FIELD

This invention relates to liquid supply systems which include a reservoir tank and a supply tank, and more particularly, to a method and apparatus for preventing the no-load operation of a pump supplying liquid from the supply tank to the reservoir tank for a liquid supply system.

BACKGROUND OF THE INVENTION

A typical liquid supply system includes a portable liquid supply tank to hold a liquid and a pump to supply the liquid in the supply tank to a reservoir tank in response to a signal from a sensor attached to the reservoir tank. The pump, operating in response to a signal from the sensor, supplies liquid thereby increasing the volume of liquid in the reservoir tank from a first predetermined volume to a second predetermined volume (the second predetermined volume being greater than the first predetermined volume). In other words, when the volume of liquid in the reservoir tank drops to a first predetermined volume, the sensor attached to the reservoir tank outputs a signal which causes the pump to supply liquid from the supply tank to the reservoir tank until the volume of liquid in the reservoir tank rises a second predetermined volume greater. Typically, the volume of liquid in the reservoir tank is detected by detecting the position of a float.

The typical liquid supply system also includes a device for preventing the no-load operation of the pump when the liquid in the supply tank is exhausted. A prior art device for preventing the no-load operation of a pump is disclosed in Japanese Utility Model Application Laid-open Gazette No. 52-116710. Such a device for preventing the no-load operation of a pump as disclosed by this reference includes a sensor for detecting the amount of liquid remaining in the supply tank. The sensor signals the pump stopping the supply of liquid to the reservoir tank when the liquid volume in the supply tank drops below a predetermined volume.

However, the pump is signaled to stop not only when the device for preventing no-load operation determines the amount of liquid in the supply tank has fallen below a predetermined volume but also when, in normal operation, the amount of liquid supplied to the reservoir tank is sensed to be sufficient. Accordingly, an operator or a user cannot correctly know from stoppage of the pump's operation whether or not it is necessary to replenish the supply of liquid in the supply tank because an insufficient amount of liquid remains for proper operation of the liquid supply system.

Additionally, if a connecting mechanism, for example, a sealing coupler, disposed on the fluid circuit between the supply tank and the pump happens to be incompletely or improperly connected such that the liquid flow from the supply tank is interrupted, the pump will operate, continuously, attempting to supply liquid to the reservoir tank, even though there may be sufficient liquid in the supply tank to adequately supply the reservoir tank. The prior art device for preventing no-load operation of a pump disclosed in Japanese Utility Model Application Laid-open Gazette No. 52-116710 does not provide an indication to a user of any abnormal conditions which may be experienced by the liquid supply apparatus such as incomplete connection of the connecting mechanism causing interrupted liquid flow.

SUMMARY OF THE INVENTION

It is a primary object of this invention to provide an improved device for preventing no-load operation of a pump of a liquid supply system.

It is another object of this invention to provide a no-load operation preventing device for a liquid supply system which correctly indicates to an operator or a user the need for supplying liquid to a supply tank and abnormal conditions of the liquid supply system.

According to the present invention, an apparatus for preventing the no-load operation of a pump for a liquid supply system includes a supply tank to accommodate liquid, a reservoir tank with a first sensor to detect the volume of liquid in the reservoir tank, a control circuit and an indication device. The supply tank includes a second sensor to detect the volume of liquid in the supply tank. In response to a signal from the first sensor, a pump supplies liquid from the supply tank to the reservoir tank until the amount of the liquid in the reservoir tank increases from a first predetermined volume to a second predetermined volume greater than the first predetermined volume. The second sensor detects the amount of the liquid in the supply tank and outputs a signal when the amount of liquid in the supply tank falls below a third predetermined volume. A control circuit responsive to the output signal of the second sensor provides a first function of stopping the operation of a pump motor and simultaneously outputting a first indication control signal, and providing a second function of stopping the operation of a pump motor when the pump operates for a period of time longer than a predetermined period of time and simultaneously outputting a second indication control signal. An indication device alerts an operator or a user, in response to the first indication control signal, that the amount of the liquid in the supply tank is below the third predetermined volume, and in response to the second indication control signal, that the pump motor of the liquid supply apparatus has operated for an abnormally long period of time.

Further objects, features and other aspects of this invention will be understood from the detailed description of the preferred embodiment of this invention with reference to the annexed drawings.

DETAILED DESCRIPTION OF THE PREFERRED EMBODIMENTS

Figure 1:
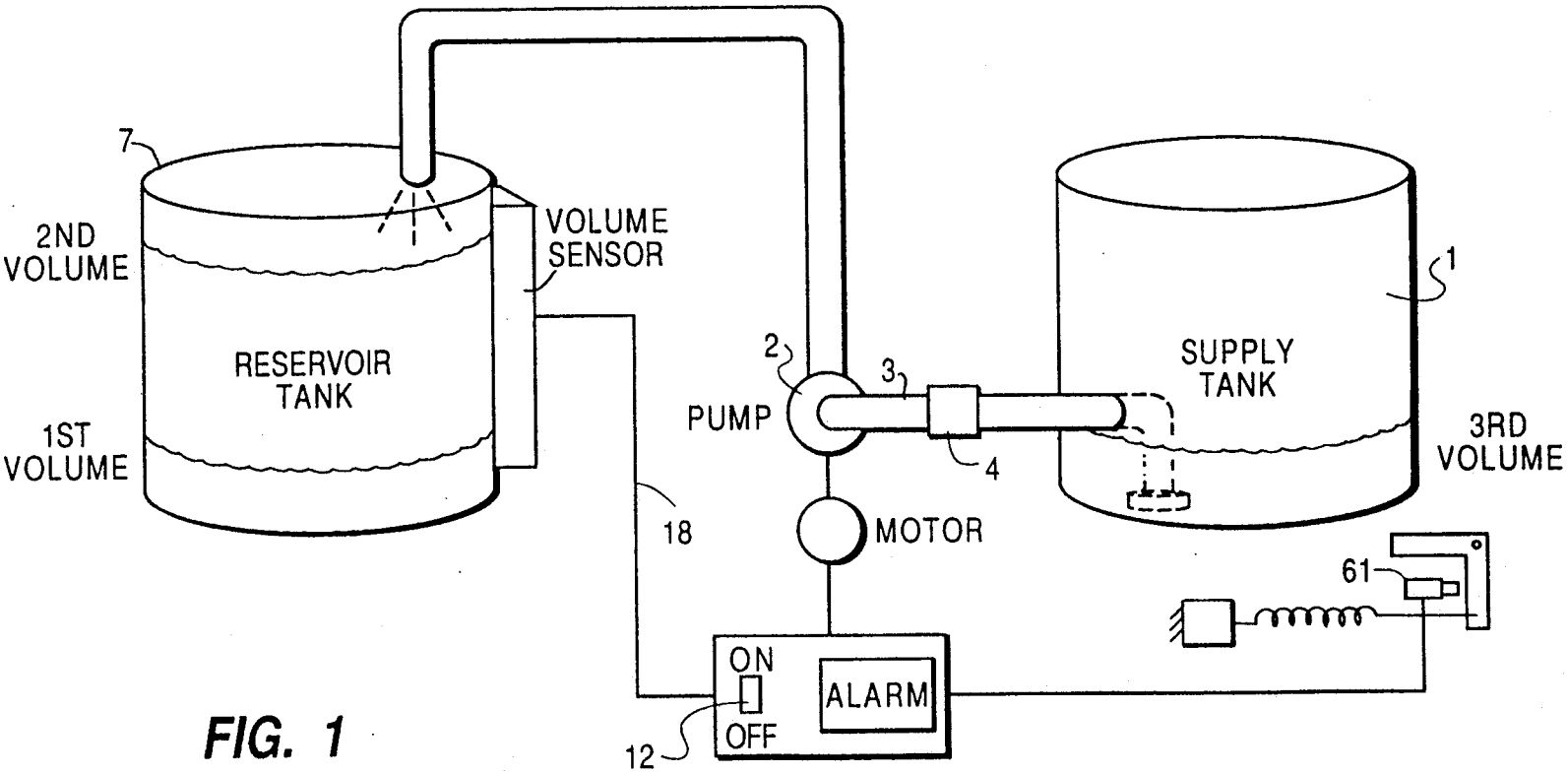
FIG. 1 is a schematic view of a liquid supply system.

FIG. 1 shows the schematic view of a liquid supply system. The liquid supply system includes supply tank 1, pump 2 to supply liquid from supply tank 1 to a reservoir tank 8, conduit 3 to communicate supply tank 1 with pump 2 and sealing coupler 4 which disposed on conduit 3 to enable the supply tank 1 to be connected to or disconnected from pump 2.

Pump 2 normally operates to increase the amount of the liquid in the reservoir tank from a first predetermined volume to a second predetermined volume after the volume of liquid in the reservoir tank has fallen to the first predetermined value.

Figure 2:
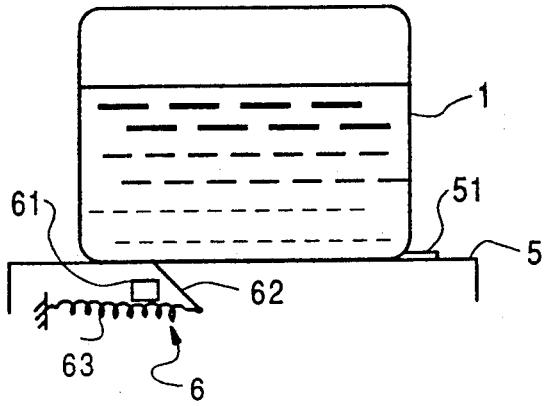
FIGS. 2 and 3 are schematic views of a detecting mechanism in a device for preventing the no-load operation of a pump and a portable liquid supply tank.
Figure 3:
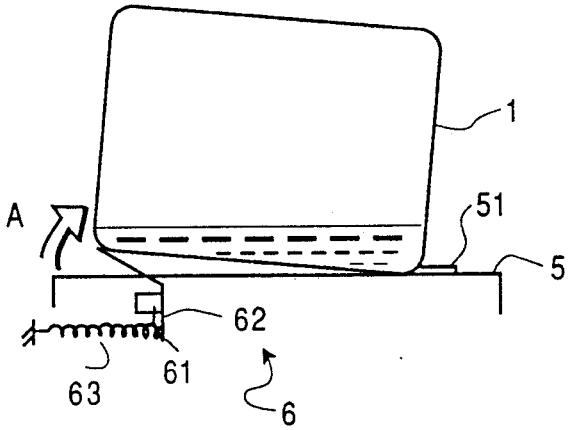
Figure 4:
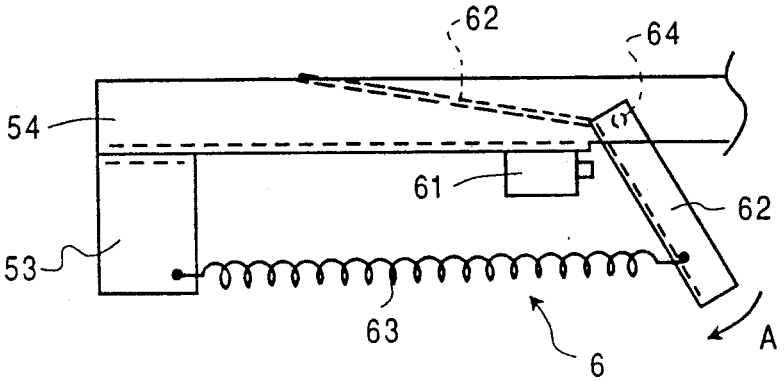
FIG. 4 is an enlarged view of a detecting mechanism as shown in FIGS. 2 and 3.

Referring to FIGS. 2, 3 and 4, the construction of a detecting mechanism of a device for preventing the no-load operation of a pump is shown. Supply tank 1 is disposed on tank stand 5 and is prevented from sliding on the upper surface of tank stand 5 by stopper 51. Stopper 51 is attached to the upper surface of tank stand 5. Detecting mechanism 6 includes micro-switch 61 attached on the bottom surface of tank stand 5 and operating plate 62 which is pivotably supported on side portion 52 of tank stand 5 with rotational pin support 64. One end of operating plate 62 is connected to one end of coil spring 63. The other end of coil spring 63 is connected to shank portion 53 of tank stand 5. Coil spring 63 urges operating plate 62 to rotate in the direction of arrow A around the axis formed by rotational pin support 64, thus causing the other end of operating plate 62 to lift one side of the bottom of supply tank 1 upward. The spring constant of coil spring 63 is chosen so that one side of supply tank 1 gradually rises in a rotational manner, rotating about the other side of the tank as an axis, as the amount of liquid in the supply tank decreases. When supply tank 1 is filled with a sufficient amount of liquid, the tank will sit flat on the upper end surface of tank stand 5 as shown in FIG. 2. When the amount of the liquid in supply tank 1 decreases below a predetermined volume, one end of supply tank 1 goes up, forced by the urging of coil spring 63 on operating plate 62. As operating plate 62 rotates, micro-switch 61 is engaged as shown in FIG. 3. When micro-switch 61 is engaged, it turns on, outputting a signal indicating that the amount of the liquid in supply tank 1 has decreased below a predetermined volume.

Figure 5:
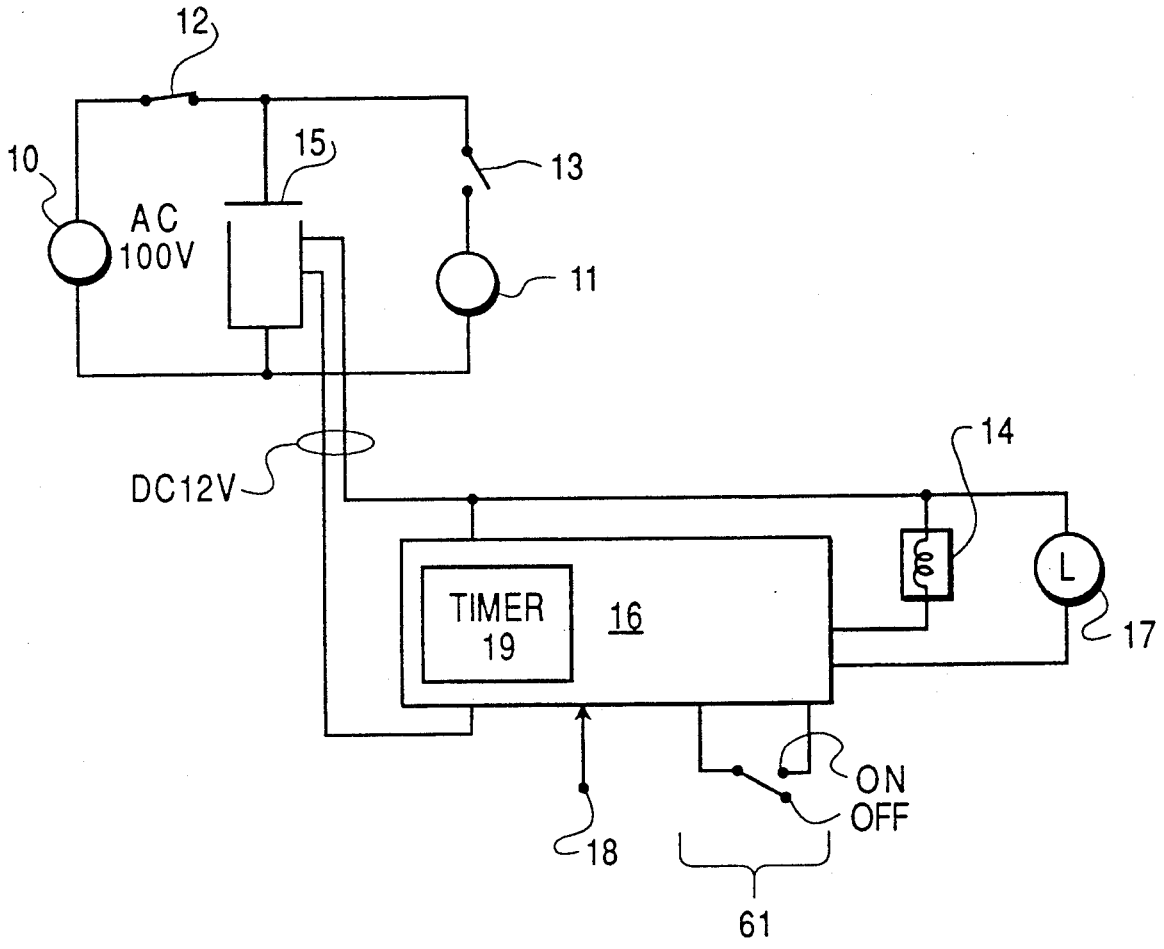
FIG. 5 is a circuit view of a device for preventing the no-load operation of a pump for a liquid supply system in accordance with one embodiment of this invention.

The construction of a device for preventing the no-load operation of a pump for a liquid supply apparatus is shown in FIG. 5.

Alternating current (AC) power source 10 is connected to motor 11 (which drives pump 2 shown in FIG. 1) through power switch 12 and contact point 13 associated with relay coil 14. Direct Current (DC) power source 15 is connected to AC power source 10 through power switch 12. DC power source 15 converts 100 Vac supplied by AC power source 10 into 12 Vdc. Control circuit 16 is supplied with power from DC power source 15. Control circuit 16 is further connected to micro-switch 61, relay coil 14 and indication lamp 17. Control circuit 16 supplies DC power to relay 14 and indication lamp 17 in accordance with the control signals provided by micro-switch 61 and detected signal 18 from a sensor attached to a reservoir tank. Contact point 13 is closed when relay coil 14 is energized. Motor 11 drives pump 2 only when power switch 12 is turned on and contact point 13 is closed.

The operation of control circuit 16 is as follows. Control circuit 16 energizes relay coil 14 by supplying electric current in response to signal 18 received from a sensor attached to a reservoir tank. When signal 18 indicates that the amount of liquid in the reservoir has fallen below a predetermined volume, control circuit 16 energizes relay coil 14 causing contact point 13 to close, thereby supplying motor 11 of pump 2 with electric current. Accordingly, while control circuit 16 receives signal 18, pump 2 supplies liquid from the supply tank 1 to reservoir tank.

If the liquid in supply tank 1 becomes exhausted while pump 2 operates, micro-switch 61 turns on and outputs a signal to control circuit 16. In response to the control signal from micro-switch 61, control circuit 16 stops supplying relay coil 14 with electric current, thus causing contact point 13 to open. The AC power supply to motor 11 is removed and pump 2 stops operating. Simultaneously, control circuit 16 outputs a first indication control signal to illuminate indication lamp 17 in a flashing or intermittent manner. Thus, an operator or a user can correctly know that the amount of the liquid in supply tank 1 has decreased below a predetermined volume. The warning function accomplished by indication lamp 17 can be performed by an audible alarm producing an intermittent sound.

Thereafter, if the liquid supply of supply tank 1 is replenished to an amount greater than the predetermined volume, micro-switch 61 turns off and control circuit 16 permits relay coil 14 to be resupplied with electric current in response to signal 18. Simultaneously, control circuit 16 stops outputting the first indication control signal to indication lamp 17 when micro-switch 61 turns off.

Control circuit 16 also has timer means for detecting when pump 2 operates for a period of time longer than a predetermined period of time and for outputting a time-out signal to control power supplied to relay coil 14 when that condition is occurs. Such a situation might exist, perhaps, when an coupler seal connection is incomplete, resulting in the interruption of the flow of liquid from supply tank 1 to pump 2. The predetermined period of time is normally chosen to be greater than the period of time required for pump 2 to supply sufficient liquid to the reservoir tank to increase the volume of liquid from the first predetermined volume to the second predetermined volume. However, the predetermined period of time could also be chosen to be a period of time less than this. Control circuit 16 deenergizes relay coil 14 in response to a time-out condition and simultaneously outputs a second indication control signal to continuously illuminate indication lamp 17. Thus, an operator or a user can correctly know pump 2 has operated for a period of time longer than that normally required to completely fill the reservoir tank to a second predetermined volume. As previously mentioned above, indication lamp 17 can be replaced by an audible warning device to sound a continuous alarm. In similar fashion, the time-out feature can be achieved by control circuit 16 continuously receiving detected signal 18 for a period of time longer than a predetermined period of time.

Once the liquid flow from the supply tank 1 to pump 2 has been reestablished and the timer 19 is reset, control circuit 16 resupplies relay coil 14 with electric current and the second indication control signal is not output any longer to indication lamp 17.

As described above, control circuit 16 has a two functions. The first function is to stop the operation of pump 2 in response to the signal output from micro-switch 61 and to simultaneously output a first indication control signal. The second function is to stop the operation of pump 2 when pump 2 operates for period of time greater than a predetermined period of time and to simultaneously output a second indication control signal.

Indication lamp 17 alerts an operator or a user to either of two conditions. The first condition is in response to the first indication control signal which is generated when the amount of the liquid in supply tank 1 falls below a predetermined volume. The second condition is in response to the second indication control signal, which is generated when pump 2 operates for a period of time longer than a predetermined period of time.

Figure 6:
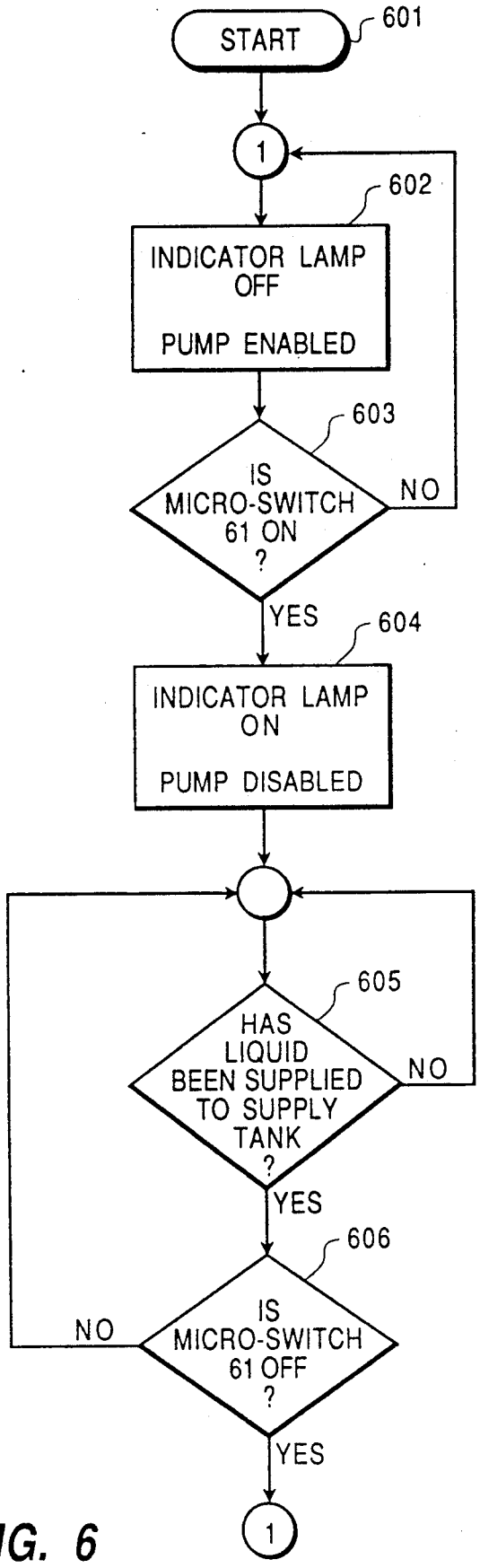
FIG. 6 is a flow diagram showing a method to determine whether the volume of liquid in the supply tank has fallen below a predetermined amount.

The method utilized by the present invention to determine whether the amount of liquid in the supply tank has fallen below a predetermined volume is illustrated in the flow diagram shown in FIG. 6. The process is entered at step 601. Initially, as shown in step 602, the indicator lamp is off and relay coil 14 is permitted to be energized, thus the enabling pump 2. At step 603, the state of micro-switch 61 is tested. If the result of that test is no, indicating the amount of liquid in supply tank 1 exceeds a predetermined level, then the process flows back to step 602 where steps 602 and 603 are continually executed until the result of the test of step 603 is yes. When the result of the test of step 603 is yes, indicating that the volume of liquid in supply tank 1 is less than a predetermined amount, the process flows to step 604 where relay coil 14 is deenergized and indicator lamp 17 is flashed on and off. The execution proceeds to step 605 where the process tests whether liquid has been supplied to supply tank 1. The process remains at step 605 until the result of the test of step 605 is yes. The state of micro-switch 61 is tested at step 606. If the result to the test of step 606 is no, then step 605 is again performed. If the result is yes, execution returns to step 602.

Figure 7:
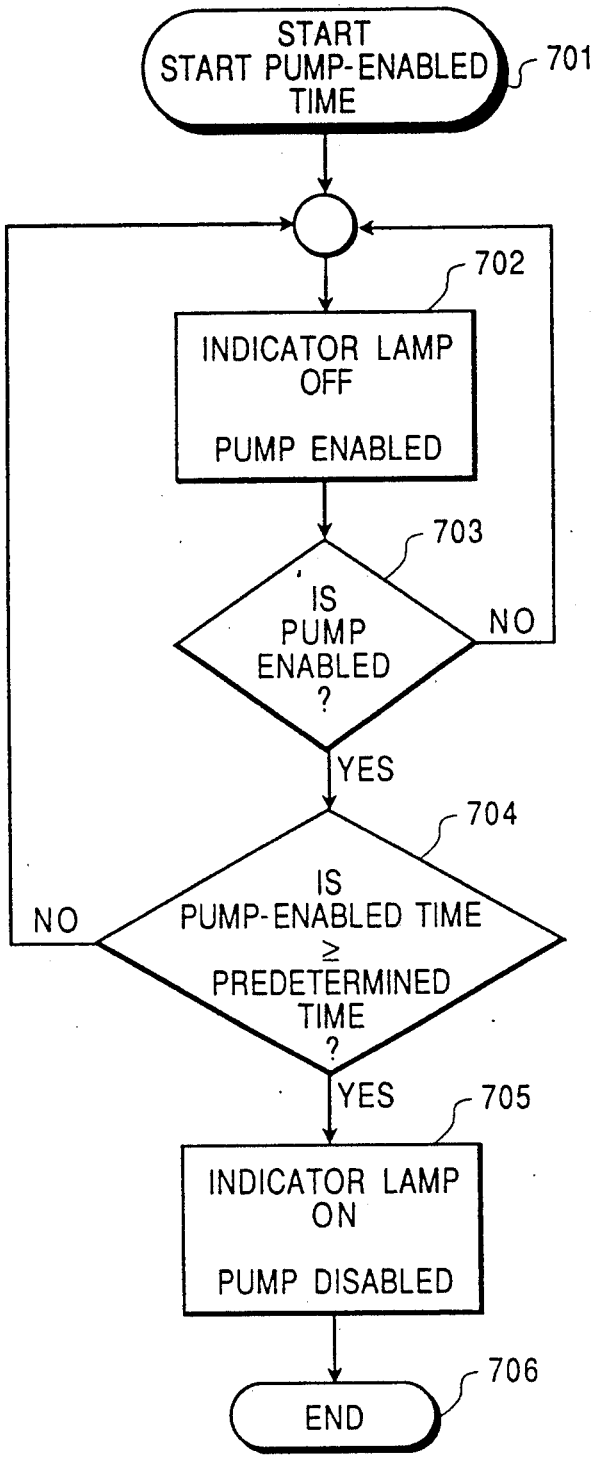
FIG. 7 is a flow diagram showing a method to determine whether the pump has operated for a period of time longer than a predetermined period of time.

FIG. 7 shows the flow diagram of the method utilized by the present invention to determine whether pump 2 has operated for a period of time longer than a predetermined period of time. Execution begins at step 701 where PUMP-ENABLED TIME is started. At step 702, indicator lamp 17 is turned off and relay coil 14 is permitted to be energized, thus enabling pump 2. At step 703, the state of pump 2 is tested to be enabled or disabled. If pump 2 is disabled, execution of the method returns to step 702. If pump 2 is enabled, the process flows to step 704, where the period of time pump 2 has been enabled is compared against a predetermined period of time. If pump 2 has not been enabled for a period of time longer than the predetermined period of time, then execution flows to step 702. If the period of time that pump 2 has been enabled exceeds the predetermined period of time, the process executes step 705 where relay coil 14 is deenergized and indicator lamp 17 is turned on with constant illumination. Execution proceeds to step 706 where the process stops.

This invention has been described in detail in connection with a preferred embodiment. This embodiment, however, is merely for example only and the invention is not restricted thereto. It will be easily understood by those skilled in the art that other variations and modifications can easily be made within the scope of this invention, as defined by the appended claims.

What is claimed is:

1. In a device for preventing the no-load operation of a pump for a liquid supply system including a supply tank to accommodate liquid, a reservoir tank connectively coupled to said supply tank, first sensor means for detecting the amount of liquid in said reservoir tank and outputting a first output signal, and a pump, said pump connectively coupled between said supply tank and said reservoir tank, said pump, in response to said first output signal from said first sensor means, supplying liquid from said supply tank to said reservoir tank until the amount of liquid in said reservoir tank increases from a first predetermined volume to a second predetermined volume, said second predetermined volume being greater than said first predetermined volume, the improvement comprises:

second sensor means for detecting the amount of liquid in said supply tank and outputting a second output signal when the amount of liquid is at a third predetermined volume;

control circuit means for controlling the operation of said pump;

said control circuit means being operable to disable the operation of said pump and to simultaneously output a first indication control signal in response to said second output signal from said second sensor means;

said control circuit means also being operable to disable the operation of said pump after a predetermined period of time and to simultaneously output a second indication control signal; and indication means responsive to each of said first and said second indication control signals separately for indicating that the operation of said pump is disabled by said control circuit means.

2. The device of claim 1 wherein said predetermined period of time is longer than the period of time required for said pump to supply an amount of liquid to said reservoir tank needed to increase the liquid volume in the reservoir tank from said first predetermined volume to said second predetermined volume.

3. The device of claim 1 wherein said second sensor means comprises:

a stand on which said supply tank is disposed;

an operating plate rotatably disposed on said stand;

a spring connected between said operation plate and said stand; and a micro-switch fixedly coupled to said stand and in proximate relation to said operating plate;

said micro-switch producing said second output signal when said operating plate engages said micro-switch.

4. The device of claim 1 wherein said indication means is a lamp.

5. The device of claim 4 wherein said lamp is intermittently illuminated in a flashing manner responsive to said first indication control signal, and said lamp is illuminated in a continuous manner responsive to said second indication control signal.

6. The device of claim 1 wherein said indication means produces an audible sound.

7. The device of claim 6 wherein said indication means produces an intermittent audible sound responsive to said first indication control signal, and said indication means produces a continuous audible sound responsive to said second indication control signal.

8. The device of claim 3 wherein said predetermined period of time is longer than the period of time required for said pump to supply an amount of liquid to said reservoir tank needed to increase the liquid volume in the reservoir tank from said first predetermined volume to said second predetermined volume.

9. A device for preventing the no-load operation of a pump for a liquid supply system comprising:

a reservoir tank having a first sensor means for detecting the amount of liquid in said reservoir tank;

said first sensor means outputting a first signal when the amount of liquid in said reservoir tank is at a first predetermined volume and outputting a second signal when the amount of liquid in said reservoir tank is at a second predetermined volume;

a supply tank to accommodate liquid, said supply tank being connectively coupled to said reservoir tank;

said supply tank having a second sensor means for detecting the amount of liquid in said supply tank;

said second sensor means outputting a third signal when the amount of liquid in said supply tank is at a third predetermined volume;

a pump connectively coupled between said reservoir tank and said supply tank for supplying liquid from said supply tank to said reservoir tank;

control circuit means for providing a first function, a second function, and a third function to control the operation of said pump;

said first function is to enable the operation of said pump in response to said first signal outputted from said first sensor means and to disable the operation of said pump in response to said second signal outputted from said first sensor means;

said second function is to disable the operation of said pump and to simultaneously output a first indication control signal in response to said third signal outputted from said second sensor means;

said third function is to disable the operation of said pump when said pump operates for longer than a predetermined period of time and to simultaneously output a second indication control signal; and indication means responsive to each of said first and said second indication control signals separately for indicating that the operation of the pump is disabled by said control circuit means.

10. The device of claim 9 wherein said predetermined period of time is longer than the period of time required for said pump to supply an amount of liquid to said reservoir tank needed to increase the liquid volume in said reservoir tank from said first predetermined volume to said second predetermined volume.

11. The device of claim 9 wherein said second sensor means comprises:

a stand on which said supply tank is disposed;

an operating plate rotatably disposed on said stand;

a spring connected between said operation plate and said stand; and a micro-switch fixedly coupled to said stand and in proximate relation to said operating plate;

said micro-switch outputting said third signal when said operating plate engages said micro-switch.

12. The device of claim 10 wherein said indication means is a lamp.

13. The device of claim 12 wherein said lamp is intermittently illuminated in a flashing manner responsive to said first indication control signal, and said lamp is illuminated in a continuous manner responsive to said second indication control signal.

14. The device of claim 9 wherein said indication means produces an audible sound.

15. The device of claim 14 wherein said indication means produces an intermittent audible sound responsive to said first indication control signal, and said indication means produces a continuous audible sound responsive to said second indication control signal.

16. The device of claim 11 wherein said predetermined period of time is longer than the period of time required for said pump to supply an amount of liquid to said reservoir tank needed to increase the liquid volume in said reservoir tank from said first predetermined volume to said second predetermined volume.

17. A method for preventing the no-load operation of a pump for a liquid supply system including a reservoir tank, a supply tank, said supply tank being connectively coupled to said reservoir tank, said reservoir tank having first sensor means for detecting the volume of liquid in said reservoir tank, said supply tank having second sensor means for detecting the volume of liquid in said supply tank, a pump connectively coupled between said supply tank and said reservoir tank, control means for controlling the operation of said pump, said control means responsive to said first and second sensor means, and indication means responsive to said control means for indicating that the operation of the pump is disabled by said control means, comprising the steps of:

detecting whether the volume of liquid in said reservoir tank is a first predetermined volume;

pumping liquid from said supply tank to said reservoir tank when the volume of liquid in said reservoir tank is said first predetermined volume;

detecting whether the volume of liquid in said supply tank is a second predetermined level;

disabling the operation of said pump when said volume of liquid in said supply tank is said second predetermined volume;

indicating the operation of the pump is disabled when the volume of liquid in said supply tank is said second predetermined volume;

detecting when the operation of said pump is enabled for a period of time longer than a predetermined period of time;

disabling the operation of said pump when said pump operates for a period of time longer than a predetermined period of time; and indicating the operation of said pump is disabled when said pump operates for a period of time longer than said predetermined period of time.

18. The method of claim 17 wherein the step of detecting when the operation of said pump is enabled for a period of time longer than a predetermined period of time comprises the step of detecting when the operation of the pump is enabled for a period of time longer than the period of time necessary to supply liquid to fill the reservoir tank from said first predetermined volume to said second predetermined volume.

* * * * *